US009294829B2

(12) United States Patent
Dannesboe et al.

(10) Patent No.: US 9,294,829 B2
(45) Date of Patent: Mar. 22, 2016

(54) WIND NOISE REDUCTION FILTER

(75) Inventors: Gorm Dannesboe, Vanløse (DK); Morten Birkmose Søndergaard, Hillerød (DK)

(73) Assignee: GN RESOUND A/S, Ballerup (DK)

( * ) Notice: Subject to any disclaimer, the term of this patent is extended or adjusted under 35 U.S.C. 154(b) by 1133 days.

(21) Appl. No.: 13/227,453

(22) Filed: Sep. 7, 2011

(65) Prior Publication Data

US 2013/0051591 A1 Feb. 28, 2013

(30) Foreign Application Priority Data

Aug. 31, 2011 (EP) ..... 11179529

(51) Int. Cl.

| | |
|---|---|
| ***H04R 9/08*** | (2006.01) |
| ***H04R 11/04*** | (2006.01) |
| ***H04R 17/02*** | (2006.01) |
| ***H04R 19/04*** | (2006.01) |
| ***H04R 21/02*** | (2006.01) |
| ***H04R 1/08*** | (2006.01) |

(52) U.S. Cl.

CPC ..... *H04R 1/086* (2013.01); *H04R 2410/07* (2013.01)

(58) Field of Classification Search

CPC ..... H04R 1/086; H04R 2410/07
USPC ..... 381/361, 365, 369, 324, 359
See application file for complete search history.

(56) References Cited

U.S. PATENT DOCUMENTS

| | | | | |
|---|---|---|---|---|
| 3,154,171 | A | 10/1964 | Knutson et al. | |
| 4,263,484 | A | 4/1981 | Hisatsune et al. | |
| 4,395,601 | A * | 7/1983 | Kopke et al. | 381/324 |
| 2008/0118096 | A1 * | 5/2008 | De Pooter et al. | 381/359 |
| 2011/0116671 | A1 | 5/2011 | Jensen | |

FOREIGN PATENT DOCUMENTS

EP 1 175 124 A2 1/2002

OTHER PUBLICATIONS

The Extended European Search Report Mailed on Sep. 2, 2012 for European Application No. 11179529.0.
International Search Report and Written Opinion dated Nov. 12, 2012 for PCT/EP2012/066998.

* cited by examiner

*Primary Examiner* — Alexander Jamal
(74) *Attorney, Agent, or Firm* — Vista IP Law Group, LLP

(57) ABSTRACT

A noise reduction filter for a microphone reducing unwanted wind noise includes a first filter element made of a first material configured to filter out wind noise, wherein the first filter element comprises a first surface configured to face towards a first microphone inlet of a first sound tube, the first microphone inlet having a central axis, and a second filter element made of a second material configured to be impermeable to wind, wherein the second filter element is configured to be positioned at the central axis so that a first part of a sound wave travelling towards the first microphone inlet is prevented by the second filter element from passing through a second surface of the first filter element into the first filter element, wherein the second surface is configured to be positioned at the central axis.

14 Claims, 5 Drawing Sheets

WIND NOISE REDUCTION FILTER

RELATED APPLICATION DATA

This application claims priority to, and the benefit of, European patent application No. 11179529.0, filed on Aug. 31, 2011, pending, the entire disclosure of which is expressly incorporated by reference herein.

FIELD

The field of the application relates to filters for a microphone inlet for reducing wind noise, audio recording devices using such filters, hearing aid systems using such audio recording devices.

BACKGROUND

Wind noise is a common problem for microphones. Wind present at the microphone inlet result in turbulence creating an audible noise. This is especially a problem when the microphone is used as part of a hearing aid system as the wind noise will lower speech intelligibility as well as induces stress on the user of the hearing aid device, due to the possible prolonged exposure of the wind noise on the user.

A possible solution to reduce wind noise is to use a porous material positioned in front of the microphone inlet for lowering the wind speed and thereby filtering out wind noise. To achieve an effective filtering effect, the porous material has to have a large size, thus increasing the total size of the microphone.

U.S. Pat. No. 3,154,171 discloses a noise suppressing filter using a porous material. However, the proposed filter has an undesirable directional sensitivity and increases the size of the microphone.

It remains a problem to provide a filter/audio recording device/hearing aid system capable of efficiently filtering out wind noise.

SUMMARY

According to a first aspect there is provided a noise reduction filter for a microphone for reducing unwanted wind noise, wherein the noise reduction filter comprises:

- a first filter element made of a first material configured to filter out wind noise, wherein said first filter element comprises a first surface configure to be positioned at a first microphone inlet of a first sound tube, the first microphone inlet having a central axis; and
- a second filter element made of a second material configured to be impermeable to wind;

wherein the second filter element is arranged to be positioned at the central axis so that a direct sound wave travelling towards the first microphone inlet with an incidence angle of zero relative to the central axis, is prevented from passing through a second surface of the first filter element into the first filter element without first interacting with second filter element, where the second surface is arranged to be positioned at the central axis, and wherein the first filter element further comprises at least one sound receiving surface allowing a part of the direct sound wave to directly propagate into the first filter element without first interacting with the second filter element.

Consequently, a compact effective noise reduction filter is provided capable of efficiently removing wind noise. By having the second filter element positioned at the central axis, incoming air flow is forced to propagate a longer way through the first filter element, thus increasing the filtering effect. By having a first filter element comprising a sound receiving surface a more uniform directionality pattern is obtained, making the filter more sensitive to directly incoming sound waves.

The first material may be different from the second material. The first material may be a porous material. The second material may be a plastic material or a metal material. The first and/or the second filter element may have round shape, a rectangular, or an un-regular shape in a plane spanned by a first axis and a second axis, where the first axis is perpendicular to the central axis, and the second axis is perpendicular to both the first axis and the central axis. The first filter element may interface with the second filter element or may interface with an intermediate element. The second surface of the first filter element may interface with the second filter element. The second surface of the first filter element may face in an opposite direction of the first surface of the first filter element. The second surface of the first filter element may face the second filter element.

The central axis of the first microphone inlet is defined as the axis being perpendicular to the first microphone inlet, and positioned in the centre of the first microphone inlet. If the first sound tube is a straight tube the central axis of the first microphone inlet is also the central axis of the first sound tube. The direct sound wave may be a direct plane wave travelling towards the first microphone inlet with an incidence angle of zero relative to the central axis so that it interacts with the second filter element before it interacts with the first surface of the first filter element.

The first filter element may have a larger widest width than the second filter element in a plane spanned by the first axis and the second axis.

In some embodiments, the material of the first filter element is a porous material.

Porous materials may comprise internal tortuous paths through out their body. Porous materials may comprise pores whose cavities are connected to one another permitting fluidic communication between the pores.

By using a porous material the wind speed is reduced before it reaches the first microphone inlet. This prevents turbulence to arise at the first microphone inlet.

In some embodiments the porous material is configured to reduce the wind speed, but at the same time being approximately acoustic transparent within frequencies of 100 Hz to 20 KHz.

In some embodiments, the second filter element covers a central part of the first filter element, and wherein the at least one sound receiving surface is positioned around at least a part of the periphery of the second filter element.

In some embodiment, the second filter element is positioned in a recess of the first filter element.

The recess may have a depth of 0.1 mm to 1 cm, or 0.2 mm to 5 mm.

In some embodiment, the second filter element comprises an outer surface facing away from the first surface of the first filter element, wherein the outer surface of the second filter element and the sound receiving surface of the first filter element are positioned in a common plane.

In some embodiments, the noise reduction filter further comprising a third filter element made of a material configured to filter out wind noise, wherein said third filter element is positioned in front of the first filter element and the second filter element relative to the first microphone inlet, so that the direct sound wave propagates in said third filter element before interacting with the first filter element and the second filter element.

The third filter element may be made of a porous material. The third filter element may interface with the first filter element and/or the second filter element. The third filter element may interface with the sound receiving surface of the first filter element. The third filter element may interface with the outer surface of the second filter element. The third filter element may have a widest width that is larger than the widest width of the second filter element. The third filter element may have a widest width that is wider than the widest width of the first filter element. The third filter element may have a widest width that is wider or equal to the widest width of the first filter element.

In some embodiment, the noise reduction filter further comprises a casing containing at least a part of the first filter element.

The casing may comprise both the first filter element and the second filter element. The casing may further comprise the third filter element. The casing may have an outer rim. The outer rim of the casing may be positioned in a common plane with the outer surface of the second filter element and the sound receiving surface of the first filter element. Alternatively the outer rim of the casing may be positioned in a common plane with an outer surface of the third filter element. The casing may be made of a rigid material providing structural strength to the filter. The material of the casing may be configured to be impermeable to wind.

In some embodiment, the common plane is position in a plane spanned by the first axis and the second axis.

In some embodiment the widest width of the filter is between 1 mm and 10 cm, 1 mm and 5 cm, 1 mm and 2 cm, 2 mm and 1 cm, or 3 mm and 1 cm. In some embodiments, the height of the filter is between 0.2 mm and 2 cm, 0.5 mm and 5 mm, or 0.5 mm and 3 mm.

In some embodiments, the noise reduction filter further comprises a fourth filter element made of a third material configured to filter out wind noise, wherein said fourth filter element comprises a first surface configure to be positioned at a second microphone inlet of a second sound tube the second microphone inlet having a central axis wherein the noise reduction filter further is configured to prevent the direct sound wave from passing through a second surface of the fourth filter element into the fourth filter element without first interacting with a impermeable filter element being impermeable to wind, where the second surface of the fourth filter element is arranged to be positioned at the central axis of the second microphone inlet, and wherein the fourth filter element further comprises at least one sound receiving surface allowing a part of the direct sound wave to directly propagate into the fourth filter element without first interacting with the impermeable filter element.

In some embodiments, the impermeable filter element is the second filter element.

In some embodiments, the impermeable filter element is a fifth filter element made of a material configured to be impermeable to wind.

In some embodiments, the first filter element, the third filter element and/or the fourth filter element is/are covered by a protective net for protecting the porous material.

The protective net may be made of acoustic transparent material. The protective net may be made of a plastic material. The average mesh size of the protective net may be between 0.02 mm and 1 mm, or 0.05 mm and 0.5 mm.

In some embodiments, the distance between the sound receiving surface of the first filter element and the sound receiving surface of the fourth filter element is larger than the distance between the central axis of the first microphone inlet and the central axis of the second microphone inlet.

According to a second aspect there is provided an audio recording device comprising a first microphone, a noise reduction filter and a first sound tube, wherein the first sound tube have a first microphone inlet at a first end configured to capture audio and the first microphone is positioned at a second end of the first sound tube, the first microphone inlet having a central axis, wherein the noise reduction filter comprises:

a first filter element made of a first material configured to filter out wind noise, wherein said first filter element comprises a first surface positioned at the first microphone inlet; and a second filter element made of a second material configured to be impermeable to wind;

wherein the second filter element is positioned at the central axis so that a direct sound wave travelling towards the first microphone inlet with an incidence angle of zero relative to the central axis, is prevented from passing through a second surface of the first filter element into the first filter element without first interacting with the second filter element, where the second surface is positioned at the central axis, and wherein the first filter element further comprises at least one sound receiving surface allowing a part of the direct sound wave to directly propagate into the first filter element without first interacting with the second filter element.

In some embodiment, the audio recording device further comprising a second microphone and a second sound tube, wherein the second sound tube have a second microphone inlet at a first end configured to capture audio and the second microphone is positioned at a second end of the second sound tube, the second microphone inlet having a central axis, wherein the noise reduction filter further comprises:

a fourth filter element made of a third material configured to filter out wind noise, wherein said fourth filter element comprises a first surface configure to be positioned at the second microphone inlet wherein the noise reduction filter further is configured to prevent the direct sound wave from passing through a second surface of the fourth filter element into the fourth filter element without first interacting with a impermeable filter element being impermeable to wind, where the second surface of the fourth filter element is arranged to be positioned at the central axis of the second microphone inlet, and wherein the fourth filter element further comprises at least one sound receiving surface allowing a part of the direct sound wave to directly propagate into the fourth filter element without first interacting with the impermeable filter element.

Consequently, a noise reduction filter is provided capable of reducing unwanted wind noise for two microphones.

The third material may be different from the first material and/or the second material. The third material may be a porous material. The third material may be the same material as the first material. The third material may be a plastic material or a metal material. The fourth filter element and/or the impermeable filter element second filter element may have round shape, a rectangular, or an un-regular shape in a plane spanned by the first axis and the second axis. The fourth filter element may interface with the impermeable filter element or may interface with an intermediate element. The second surface of the fourth filter element may face in an opposite direction of the first surface of the fourth filter element. The second surface of the fourth filter element may face the impermeable filter element.

In some embodiments, the impermeable filter element is the second filter element.

In some embodiments, the impermeable filter element is a fifth filter element made of a material configured to be impermeable to wind.

In some embodiments, the first filter element and the fourth filter element may be arranged with a distance between them so that a sound wave propagating in the first filter element is prevented from directly propagate from the first filter element into the fourth filter element.

Consequently, the signals recorded by the first microphone may be more independent of the signals recorded by the second microphone.

The central axis of the second microphone inlet is defined as the axis being perpendicular to the second microphone inlet, and positioned in the centre of the second microphone inlet. If the second sound tube is a straight tube the central axis of the second microphone inlet is also the central axis of the second sound tube. The direct sound wave may be a direct plane wave travelling towards the second microphone inlet with an incidence angle of zero relative to the central axis so that it interacts with the impermeable filter element before it interacts with the first surface of the fourth filter element.

When two or more audio signals recorded at different spatial positions are available, various signal processing techniques may be used to improve the resulting signal quality. However, it is a requirement that the recorded audio signals are spatial distinct to a certain degree for the signal processing techniques to be effective. This is normally achieved by spacing the two or more microphones apart to achieve a desired spatial distinctiveness of the recorded signals. This will however increase the overall size and resulting complexity of the audio recording device.

In some embodiments, the distance between the sound receiving surface of the first filter element and the sound receiving surface of the fourth filter element is larger than the distance between the central axis of the first microphone inlet and the central axis of the second microphone inlet.

Consequently, the distance between the two microphones may be reduced as the resulting spatial distinctiveness of the recorded signals correspondingly can be increased by moving the sound receiving surface further apart. This enable to overall size and complexity of the sound recording device to be decreased.

The distance between the sound receiving surface of the first filter element and the sound receiving surface of the fourth filter element may be measured from the centre of each sound receiving surface.

In some embodiments, the distance between the centre of the sound receiving surface of the first filter element and the centre of the sound receiving surface of the fourth filter element is at least 10% larger, 20% larger, 30% larger, 40% larger or 50% larger than the distance between the central axis of the first microphone inlet and the central axis of the second microphone inlet.

According to a third aspect there is provided a hearing aid system comprising a hearing aid device configured to be worn at the ear of a user, and an audio recording device, wherein the audio recording device comprises a microphone, a noise reduction filter and a first sound tube, wherein the first sound tube have a first microphone inlet at a first end configured to capture audio and the microphone is positioned at a second end of the first sound tube, the first microphone inlet having a central axis, wherein the noise reduction filter comprises:

a first filter element made of a first material configured to filter out wind noise, wherein said first filter element comprises a first surface positioned at the first microphone inlet; and a second filter element made of a second material configured to prevent a majority of the air flow that is incident on the second filter element;

wherein the second filter element is positioned at the central axis so that an air flow travelling towards the first microphone inlet with an incidence angle of zero relative to the central axis, is prevented from directly blowing through a second surface of the first filter element into the first filter element, where the second surface is positioned at the central axis, and wherein the first filter element further comprises at least one sound receiving surface allowing a part of the direct sound wave to directly propagate from air into the first filter element without first interacting with the second filter element, wherein the audio recording device is configured to record an audio signal and transmit the recorded audio signal to the hearing aid device.

One or more embodiments described herein relate to different aspects including the wind noise reduction filter, the audio recording device and the hearing aid system described above and in the following, each yielding one or more of the benefits and advantages described in connection with the first mentioned aspect, and each having one or more embodiments corresponding to the embodiments described in connection with the first mentioned aspect and/or disclosed in the appended claims.

In accordance with some embodiments, a noise reduction filter for a microphone reducing unwanted wind noise includes a first filter element made of a first material configured to filter out wind noise, wherein the first filter element comprises a first surface configured to face towards a first microphone inlet of a first sound tube, the first microphone inlet having a central axis, and a second filter element made of a second material configured to be impermeable to wind, wherein the second filter element is configured to be positioned at the central axis so that a first part of a sound wave travelling towards the first microphone inlet is prevented by the second filter element from passing through a second surface of the first filter element into the first filter element, wherein the second surface is configured to be positioned at the central axis, and wherein the first filter element further comprises a sound receiving surface allowing a second part of the sound wave to propagate into the first filter element without interacting with the second filter element.

In accordance with other embodiments, an audio recording device includes a first microphone, a noise reduction filter, and a first sound tube having a first end and a second end, wherein the first sound tube has a first microphone inlet at the first end configured to capture sound, and the first microphone is located at the second end of the first sound tube, the first microphone inlet having a central axis, wherein the noise reduction filter comprises a first filter element made of a first material configured to filter out wind noise, wherein the first filter element comprises a first surface facing the first microphone inlet, and a second filter element made of a second material configured to be impermeable to wind, wherein the second filter element is located at the central axis so that a first part of a sound wave travelling towards the first microphone inlet is prevented by the second filter element from passing through a second surface of the first filter element into the first filter element, where the second surface is positioned at the central axis, and wherein the first filter element further comprises a sound receiving surface allowing a second part of the sound wave to propagate into the first filter element without interacting with the second filter element.

In accordance with other embodiments, a hearing aid system includes a hearing aid device configured to be worn at the ear of a user, and an audio recording device, wherein the audio recording device comprises a microphone, a noise reduction filter, and a first sound tube having a first end and a second end, wherein the first sound tube has a first microphone inlet at the first end configured to capture sound, and the microphone is located at the second end of the first sound tube, the first microphone inlet having a central axis, wherein the noise reduction filter comprises a first filter element made of a first material configured to filter out wind noise, wherein the first filter element comprises a first surface facing the first microphone inlet, and a second filter element made of a second material configured to be impermeable to wind, wherein the second filter element is located at the central axis so that a first part of a sound wave travelling towards the first microphone inlet is prevented by the second filter element from passing through a second surface of the first filter element into the first filter element, where the second surface is positioned at the central axis, wherein the first filter element further comprises a sound receiving surface allowing a second part of the sound wave to directly propagate into the first filter element without interacting with the second filter element, and wherein the audio recording device is configured to record an audio signal and transmit the recorded audio signal to the hearing aid device.

Other and further aspects and features will be evident from reading the following detailed description of the embodiments.

BRIEF DESCRIPTION OF THE DRAWINGS

The drawings illustrate the design and utility of embodiments, in which similar elements are referred to by common reference numerals. These drawings are not necessarily drawn to scale. In order to better appreciate how the above-recited and other advantages and objects are obtained, a more particular description of the embodiments will be rendered, which are illustrated in the accompanying drawings. These drawings depict only typical embodiments and are not therefore to be considered limiting of its scope.

DETAILED DESCRIPTION

Figure 1A:
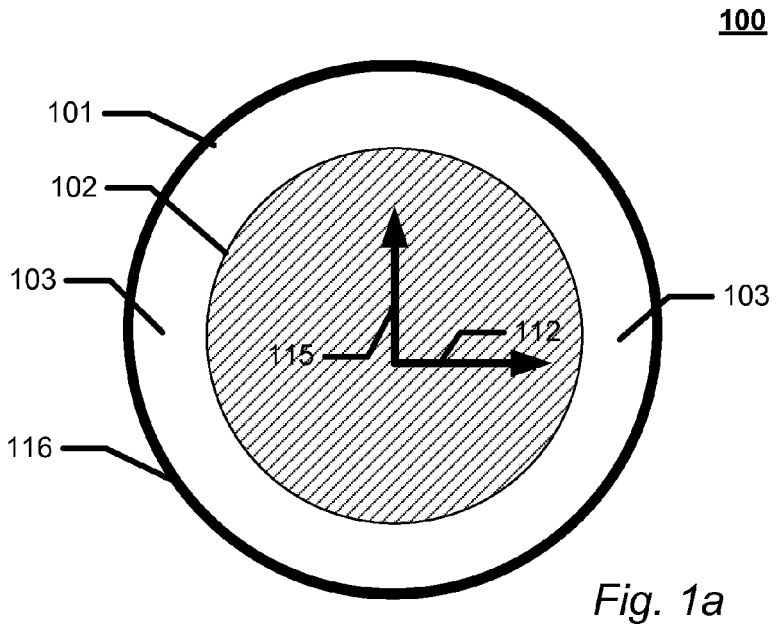
FIG. 1*a-b* show an audio recording device comprising a noise reduction filter according to some embodiments.

Various embodiments are described hereinafter with reference to the figures. It should be noted that the figures are not drawn to scale and that the elements of similar structures or functions are represented by like reference numerals throughout the figures. It should be noted that the figures are only intended to facilitate the description of the embodiments. They are not intended as an exhaustive description of the invention or as a limitation on the scope of the invention. In addition, an illustrated embodiment need not have all the aspects or advantages shown. An aspect or an advantage described in conjunction with a particular embodiment is not necessarily limited to that embodiment and can be practiced in any other embodiments even if not so illustrated. Also, reference throughout this specification to "some embodiments" or "other embodiments" means that a particular feature, structure, material, or characteristic described in connection with the embodiments is included in at least one embodiment. Thus, the appearances of the phrase "in some embodiments" or "in other embodiments" in various places throughout this specification are not necessarily referring to the same embodiment or embodiments.

Figure 1B:
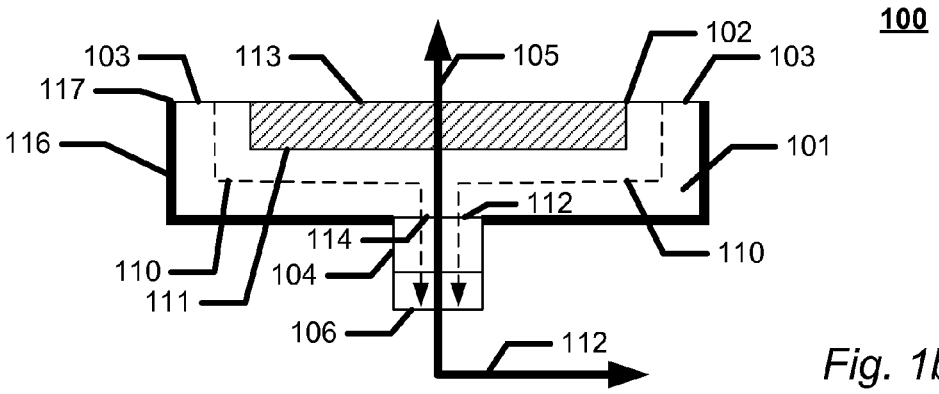

FIG. 1*a-b* show an audio recording device 100 comprising a noise reduction filter according to some embodiments. FIG. 1*a* shows a top view of the audio recording device 100 and FIG. 1*b* shows a side view of the audio recording device 100. The audio recording device 100 comprises a noise reduction filter 101 102, a first sound tube 104, and a microphone 106. The noise reduction filter 101 102 comprises a first filter element 101 made of a first material configured to filter out wind noise and a second filter element 102 made of a second material configured to be impermeable to wind. The first sound tube 104 comprises a first microphone inlet 114 interfacing with a first surface 112 of the first filter element 101, the first microphone inlet 114 having a central axis 105. In this embodiment the first sound tube 104 is a straight tube and the central axis 105 of the first microphone inlet 114 is therefore also the central axis of the first sound tube 104. The second filter element 102 is positioned in a recess in the first filter element 101. The first filter element 101 and the second filter element 102 have a round shape in a plane spanned by the first axis 112 and the second axis 115, where the first axis 112 is perpendicular to the central axis 105 and the second axis 115 is perpendicular to both the first axis 112 and the central axis 105 of the first microphone inlet 114. In this embodiment, both the first filter element 101 and the second filter element 102 are centred on the central axis 105.

The second filter element 102 is positioned at the central axis 105 so that a direct sound wave travelling towards the first microphone inlet with an incidence angle of zero relative to the central axis 105 is prevented from directly passing through a second surface 111 of the first filter element 101 positioned at the central axis 105 (without first interacting with the second filter element). The first filter element 101 comprises a sound receiving surface 103 allowing the direct sound wave to directly propagate into the first filter element without first interacting with the second filter element 102. As the second filter element 102 is impermeable to wind, this arrangement forces an incoming air flow to propagate around the second filter element 102 approximately along the illustrated path 110 in the first filter element 101. This increases the length the incoming air flow has to travel in the first filter element 101 and thereby the filtering effect of the first filter element 101. By having a sound receiving surface 103 not covered by the second filter element 102, a directional uniform sensitivity, a high sensitivity to directly incoming sound waves and a more compact design can be achieved.

The second filter element 102 comprises an outer surface 113 facing away from the first microphone inlet 114. In this embodiment, the outer surface 113, the sound receiving surface 103 and a rim 117 on the casing 116 are positioned in a common plane.

Figure 1C:
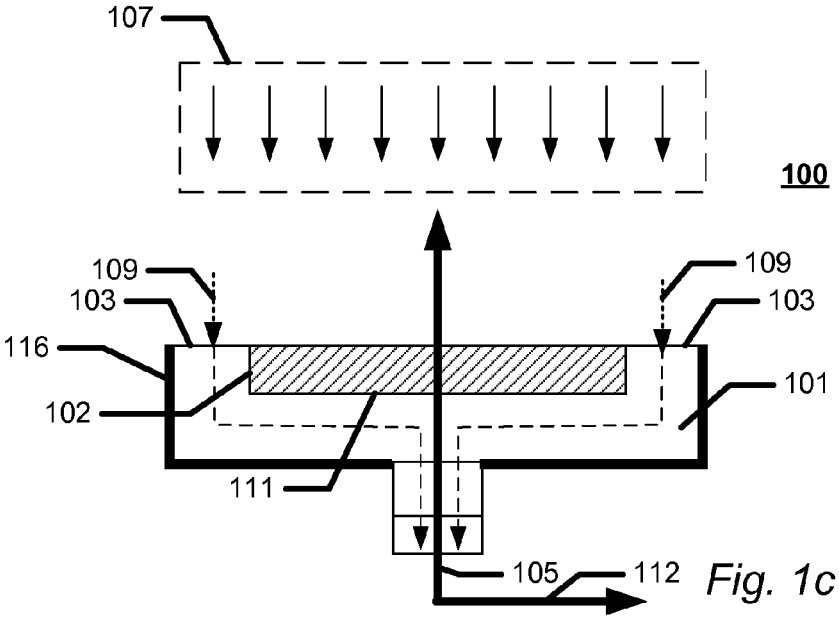
FIG. 1*c* illustrates how an audio recording device comprising a noise reduction filter interacts with a direct sound wave in accordance with some embodiments.

FIG. 1*c* illustrates how an audio recording device 100 comprising a wind noise reduction filter 101 102 as shown in FIG. 1*a-b* interacts with a direct sound wave 107. Shown is a direct sound wave 107 propagating towards the first microphone inlet with an incidence angle of zero relative to the central axis 105. The second filter element 102 is arranged to be positioned at the central axis 105 so that the direct sound wave 107 (and a direct airflow) is prevented from passing trough a second surface 111 of the first filter element, without first interacting with the second filter element 102. The sound receiving surface 103 of the first filter element is arranged to allow a part of the direct sound wave 107 to directly propagate into the first filter element without first interacting with the second filter element. This arrangement of the first filter element 101 and the second filter element 102 prevents an airflow from passing straight through the first filter element 101, and forces the airflow the long way around. This increases the effective thickness of the filter and at the same time provides a good directional uniform sensitivity for the microphone 106.

Figure 2A:
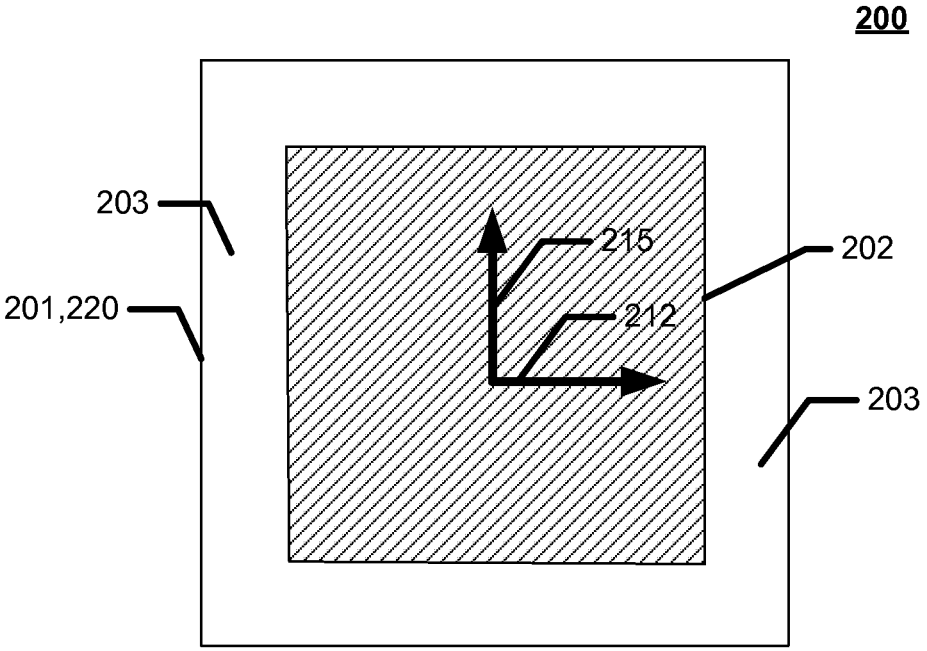
FIG. 2*a-b* show an audio recording device comprising a noise reduction filter according to some embodiments.
Figure 2B:
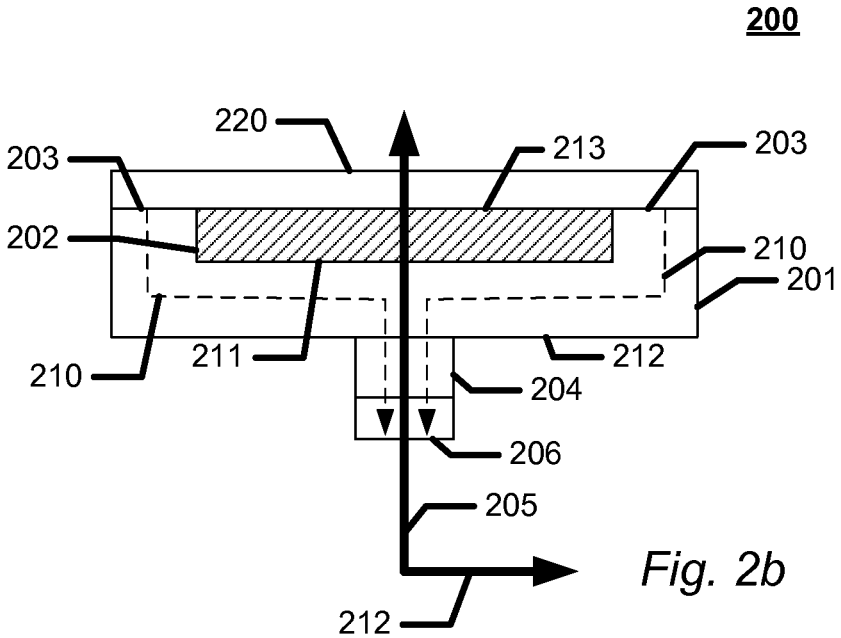

FIGS. 2*a-b* show an audio recording device comprising a noise reduction filter according to some embodiments. FIG. 2*a* shows a top view of the audio recording device 200 and FIG. 2*b* shows a side view of the audio recording device 200. The audio recording device 200 comprises a noise reduction filter 201 202 220 a first sound tube 204 and a microphone 206. The noise reduction filter 201 202 220 comprises a first filter element 201 made of a first material configured to filter out wind noise, a second filter element 202 made of a second material configured to be impermeable to wind, and a third filter element 220 made of a material configured to filter out wind noise. The first filter element and the third filter element 201 220 may both be made of the same material. The first filter 201 and the third filter element 220 may both be made of a porous material. The first filter element 201 comprises a sound receiving surface 203. In this embodiment the first filter element 201 and the second filter element 202 have a rectangular shape in a plane spanned by a first axis 212 and a second axis 215, where the first axis 212 is perpendicular to the central axis 205 and the second axis 215 is perpendicular to both the first axis 212 and the central axis 205. The third filter element 220 interfaces with the sound receiving surface of the first filter element 203 and an outer surface 213 of the second filter element 202. This arrangement may provide a more effective filter.

Figure 3A:
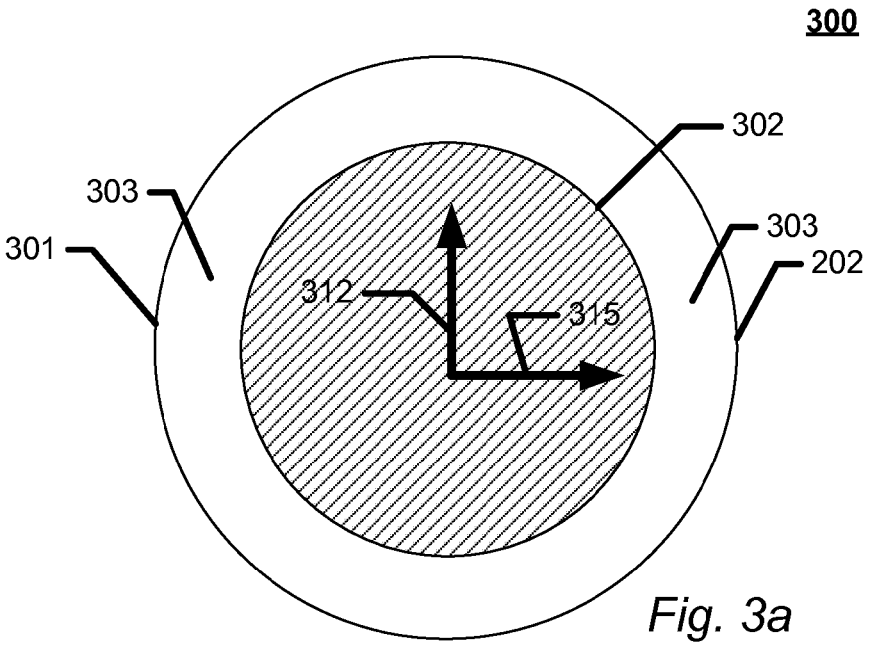
FIG. 3*a-b* show an audio recording device comprising a noise reduction filter according to some embodiments.
Figure 3B:
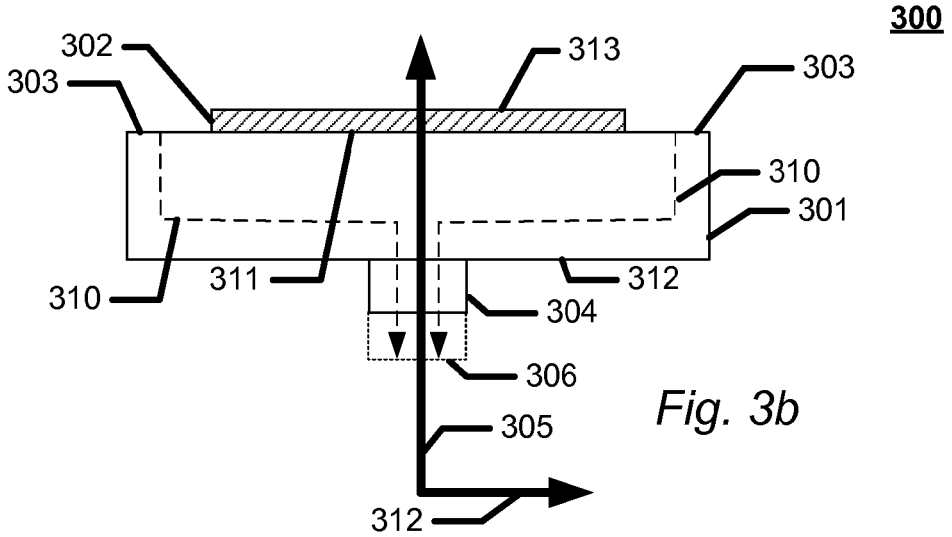

FIG. 3*a-b* show an audio recording device comprising a noise reduction filter according to some embodiments. FIG. 3*a* shows a top view of the audio recording device 300 and FIG. 3*b* shows a side view of the audio recording device 300. The audio recording device 300 comprises a noise reduction filter 301 302 a first sound tube 304 and a microphone 306. The noise reduction filter 301 302 comprises a first filter element 301 made of a first material configured to filter out wind noise, and a second filter element 302 made of a second material configured to be impermeable to wind. The first filter element 301 comprises a sound receiving surface 303. In this embodiment the second filter element 302 is protruding from the first filter element 301.

Figure 4:
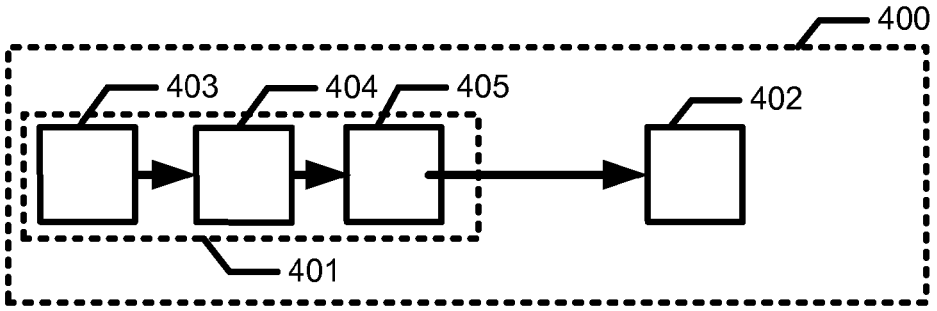
FIG. 4 shows a hearing aid system according to some embodiments.

FIG. 4 shows a hearing aid system according to some embodiments. The hearing aid system 400 comprises an audio recording device 401 and a hearing aid device 402. The audio recording device 401 comprises a noise reduction filter 403 a first sound tube 404 and a microphone 405. The audio recording device 401 is configured to record an audio signal and transmit the recorded audio signal to the hearing aid device 402.

FIG. 5*a-d* show side views of audio recording devices having different sound receiving surfaces according to some embodiments.

Figure 5A:
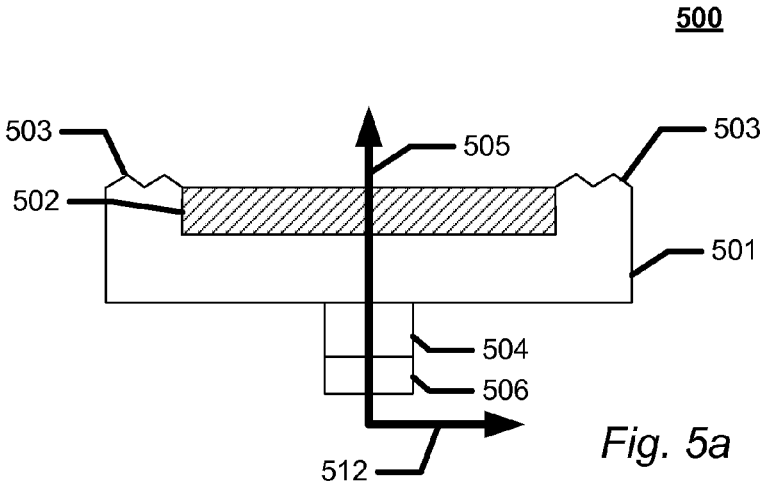
FIG. 5*a-d* show side views of audio recording devices having different sound receiving surfaces according to some embodiments.

FIG. 5*a* shows an audio recording device 501 502 according to some embodiments, having a sound receiving surface 503 comprising protruding features.

Figure 5B:
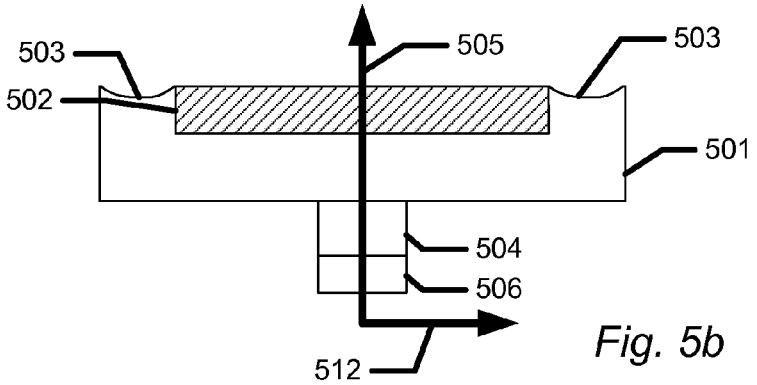

FIG. 5*b* shows an audio recording device 501 502 according to some embodiments, having a concave sound receiving surface 503.

Figure 5C:
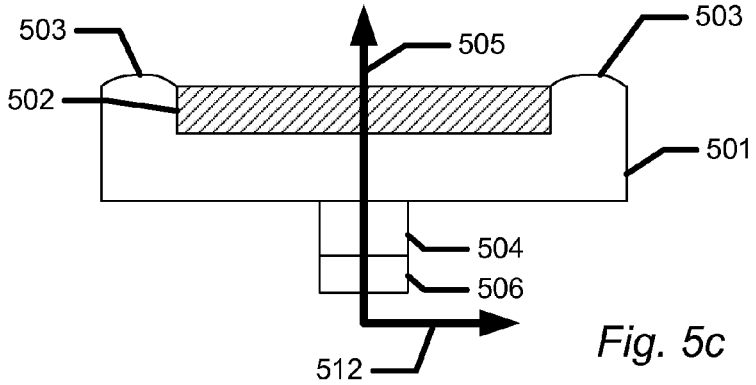

FIG. 5*c* shows an audio recording device 501 502 according to some embodiments, having a convex sound receiving surface 503.

Figure 5D:
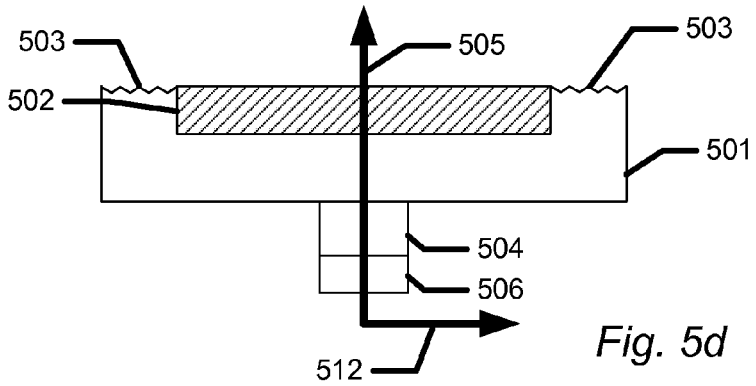

FIG. 5*d* shows an audio recording device 501 502 according to some embodiments, having a jagged sound receiving surface 503.

Figure 6A:
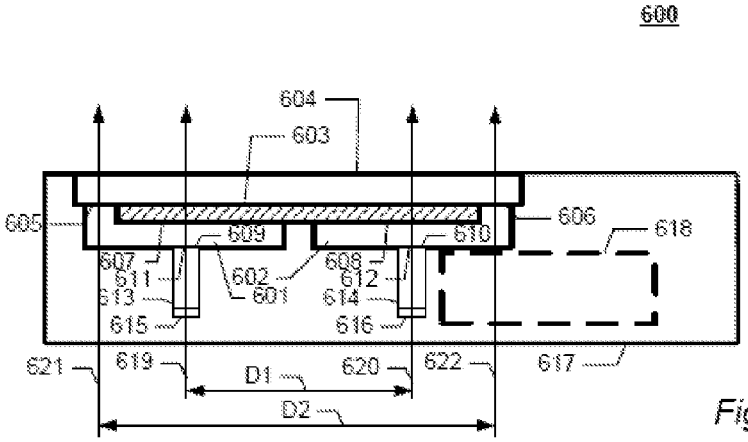
FIG. 6*a-b* show an audio recording device comprising two microphones according to some embodiments.
Figure 6B:
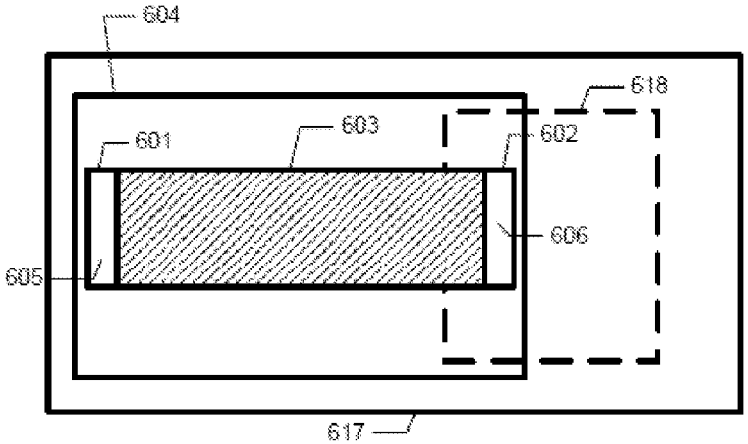

FIG. 6*a-b* show an audio recording device comprising two microphones according to some embodiments. FIG. 6*a* shows a side view and FIG. 6*b* shows a top view. The audio recording device 600 comprises a first microphone 615, a second microphone 616, a first sound tube 613, a second sound tube 614, a noise reduction filter 601 602 603 604, a battery 618 and a casing 617. The first sound tube 613 has a first microphone inlet 611 positioned at a first end configured to capture audio and the first microphone 615 is positioned at a second end of the first sound tube 613. The second sound tube 614 have a second microphone inlet 612 positioned at a first end configured to capture audio and the second microphone 616 is positioned at a second end of the second sound tube 614. The first microphone inlet 611 has a central axis 619 and the second microphone inlet 612 has a central axis 620. The noise reduction filter comprises a first filter element 601, a second filter element 603, a third filter element 604 and a fourth filter element 602. The first filter element 601, the third filter element 604 and the fourth filter element 602 is made of a material configured to filter out wind noise e.g. a porous material. The second filter element 603 is made of a material configured to be impermeable to wind. The first filter element comprises a first surface 609 positioned at the first microphone inlet 611, and the fourth filter element 602 comprises a first surface 610 positioned at the second microphone inlet 612. The second filter element is arranged to be positioned at the central axis of both the first microphone inlet 619 and the central axis of the second microphone inlet 620. This positioning prevents a direct sound wave, propagating towards the first microphone inlet 611 and the second microphone inlet 612 with an incident angle of zero relative to the central axis 619 620, from passing directly into the first filter element 601 through a second surface 607 of the first filter element or directly into the fourth filter element 602 through a second surface 608 of the fourth filter element 602, without first interacting with the second filter element 603. The first filter element 601 comprises a sound receiving surface 605 and the fourth filter element comprises a sound receiving surface 606. The sound receiving surfaces 605 606 allows a part of the direct sound wave to directly propagate into the first filter element 601/fourth filter element 602 without first interacting with the second filter element 603. The sound receiving surfaces 605 606 have a rectangular shape, and are positioned in a common plane with an outer surface of the second filter element 603. The sound receiving surfaces 605 606 interface with the third filter element 604. The sound receiving surfaces 605 606 are positioned on opposite sides of the second filter element 603. The third filter element 604 comprises an outer surface that have a surface area that is at least 5%, 10%, 25% larger than the combined surface area of the outer surfaces of the second filter element 603, the sound receiving surface of the first filter element 605, and the sound receiving surface of the fourth filter element, 606. This may further reduce turbulence at the microphone inlets 611 612, thereby further reducing wind noise.

When two or more audio signals recorded at different spatial positions are available, various signal processing techniques may be used to improve the resulting signal quality.

However, it is a requirement that the recorded audio signals are spatial distinct to a certain degree for the signal processing techniques to be effective. This is normally achieved by spacing the two or more microphones apart to achieve the desired spatial distinctiveness of the recorded signals. This will however increase the overall size and resulting complexity of the audio recording device.

In this embodiment, the sound receiving surfaces 605 606 are positioned so that the distance D2 between the centre of the sound receiving surfaces is larger than the distance between the central axes of the microphone inlets D1.

Consequently, the distance between the two microphone may be reduced as the resulting spatial distinctiveness of the recorded signals correspondingly is increased by moving the sound receiving surfaces 605 606 further apart. This enable to overall size and complexity of the sound recording device to be decreased.

Figure 6C:
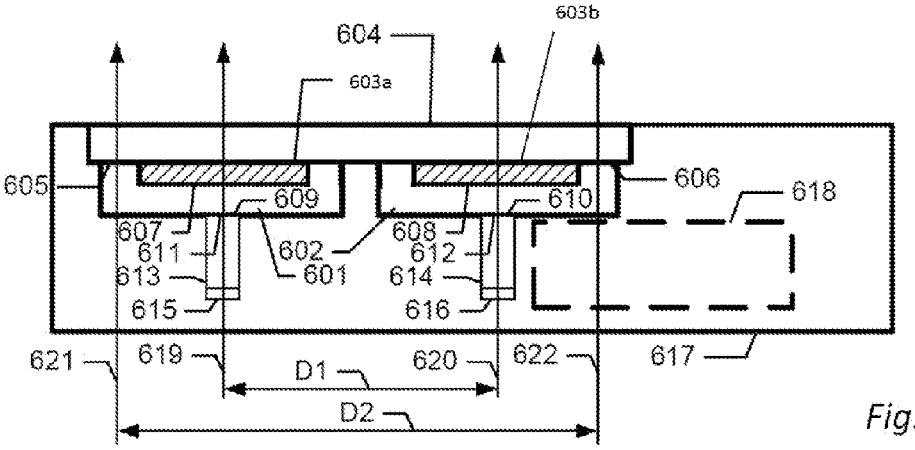
FIG. 6*c* shows another audio recording device.

As described, in some embodiments, the impermeable filter element may be a fifth filter element. FIG. 6*c* illustrates another audio recording device having a first filter element 601, a second filter element 603*a*, a third filter element 602, a fourth filter element 603*b*, and a fifth filter element 604.

It should be emphasized that the term "comprises/comprising" when used in this specification is taken to specify the presence of stated features, integers, steps or components but does not preclude the presence or addition of one or more other features, integers, steps, components or groups thereof.

In device claims enumerating several elements, several of these elements may be embodied by one and the same device or item of hardware. The mere fact that certain elements are recited in mutually different dependent claims or described in different embodiments does not indicate that a combination of these elements cannot be used to advantage.

Also, as used in this specification, the terms "first filter element", "second filter element", "third filter element", "fourth filter element", and "fifth filter element", and any of other similar terms, are used to distinguish different filter elements from each other, and they do not necessarily refer to the same respective filter elements in different embodiments. Thus, any of these terms may be used to refer to any of the filter elements described herein in different embodiments. For example, the term "third filter element" may be used to refer to refer to the filter element 602 in some embodiments, or to the filter element 604 in other embodiments.

Although some embodiments have been described and shown in detail, the claimed invention is not restricted to them, but may also be embodied in other ways within the scope of the subject matter defined in the following claims. In particular, it is to be understood that other embodiments may be utilised, and structural and functional modifications may be made without departing from the scope of the claimed invention. The specification and drawings are, accordingly, to be regarded in an illustrative rather than restrictive sense. The claimed invention is intended to cover alternatives, modifications, and equivalents.

The invention claimed is:

1. A noise reduction filter for a microphone reducing unwanted wind noise, comprising:

a first filter element made of a first material configured to filter out wind noise, wherein the first filter element comprises a first surface configured to face towards a first microphone inlet of a first sound tube, the first microphone inlet having a central axis; and a second filter element made of a second material configured to be impermeable to wind;

wherein the second filter element is configured to be positioned at the central axis so that a first part of a sound wave travelling towards the first microphone inlet is prevented by the second filter element from passing through a second surface of the first filter element into the first filter element, wherein the second surface is configured to be positioned at the central axis;

wherein the first filter element further comprises a sound receiving surface allowing a second part of the sound wave to propagate into the first filter element without interacting with the second filter element; and wherein the noise reduction filter further comprises:

a third filter element configured to filter out wind noise, wherein the third filter element comprises a first surface configured to face towards a second microphone inlet of a second sound tube, the second microphone inlet having a central axis;

wherein the second filter element is configured to prevent a third part of the sound wave from passing through a second surface of the third filter element into the third filter element, wherein the second surface of the third filter element is configured to be positioned at the central axis of the second microphone inlet; and wherein the third filter element further comprises a sound receiving surface allowing a fourth part of the sound wave to propagate into the third filter element without interacting with the second filter element.

2. The noise reduction filter according to claim 1, wherein the first material of the first filter element comprises a porous material.

3. The noise reduction filter according to claim 1, wherein at least a part of the second filter element is located in a recess of the first filter element.

4. The noise reduction filter according to claim 1, wherein the second filter element comprises an outer surface, the outer surface of the second filter element and the sound receiving surface of the first filter element being in a common plane.

5. The noise reduction filter according to claim 1, further comprising a fourth filter element located in front of the first, second, and third filter elements so that the fourth filter element can first interact with the wind noise before the wind noise reaches the first, second, and third filter elements.

6. The noise reduction filter according to claim 1, wherein a distance D2 between the sound receiving surface of the first filter element and the sound receiving surface of the third filter element is larger than a distance D1 between the central axis of the first microphone inlet and the central axis of the second microphone inlet.

7. A noise reduction filter for a microphone reducing unwanted wind noise, comprising:

a first filter element made of a first material configured to filter out wind noise, wherein the first filter element comprises a first surface configured to face towards a first microphone inlet of a first sound tube, the first microphone inlet having a central axis; and a second filter element made of a second material configured to be impermeable to wind;

wherein the second filter element is configured to be positioned at the central axis so that a first part of a sound wave travelling towards the first microphone inlet is prevented by the second filter element from passing through a second surface of the first filter element into the first filter element, wherein the second surface is configured to be positioned at the central axis;

wherein the first filter element further comprises a sound receiving surface allowing a second part of the sound wave to propagate into the first filter element without interacting with the second filter element; and wherein the noise reduction filter further comprises:

a third filter element configured to filter out wind noise, wherein said third filter element comprises a first surface configured to face towards a second microphone inlet of a second sound tube, the second microphone inlet having a central axis; and a fourth filter element that is impermeable to wind;

wherein the fourth filter element is configured to prevent a third part of the sound wave from passing through a second surface of the third filter element into the third filter element, wherein the second surface of the third filter element is configured to be positioned at the central axis of the second microphone inlet; and wherein the third filter element further comprises a sound receiving surface allowing a fourth part of the sound wave to propagate into the third filter element without interacting with the fourth filter element.

8. The noise reduction filter according to claim 7, further comprising a fifth filter element located in front of the first, second, third, and fourth filter elements so that the fifth filter element can first interact with the wind noise before the wind noise reaches the first, second, third, and fourth filter elements.

9. The noise reduction filter according to claim 7, wherein a distance D2 between the sound receiving surface of the first filter element and the sound receiving surface of the third filter element is larger than a distance D1 between the central axis of the first microphone inlet and the central axis of the second microphone inlet.

10. An audio recording device, comprising:

a first microphone;

a noise reduction filter; and a first sound tube having a first end and a second end, wherein the first sound tube has a first microphone inlet at the first end configured to capture sound, and the first microphone is located at the second end of the first sound tube, the first microphone inlet having a central axis;

wherein the noise reduction filter comprises:

a first filter element made of a first material configured to filter out wind noise, wherein the first filter element comprises a first surface facing the first microphone inlet; and a second filter element made of a second material configured to be impermeable to wind;

wherein the second filter element is located at the central axis so that a first part of a sound wave travelling towards the first microphone inlet is prevented by the second filter element from passing through a second surface of the first filter element into the first filter element, where the second surface is positioned at the central axis; and wherein the first filter element further comprises a sound receiving surface allowing a second part of the sound wave to propagate into the first filter element without interacting with the second filter element;

wherein the audio recording device further comprises a second microphone, and a second sound tube having a first end and a second end, wherein the second sound tube has a second microphone inlet at the first end configured to capture sound, and the second microphone is positioned at the second end of the second sound tube, the second microphone inlet having a central axis; and wherein the noise reduction filter further comprises:

a third filter element configured to filter out wind noise, wherein the third filter element comprises a first surface configure to face towards the second microphone inlet;

wherein a third part of the sound wave is prevented by an impermeable filter element from passing through a second surface of the third filter element into the third filter element, wherein the second surface of the third filter element is configured to be positioned at the central axis of the second microphone inlet; and wherein the third filter element further comprises a sound receiving surface allowing a fourth part of the sound wave to propagate into the third filter element without interacting with the impermeable filter element.

11. The audio recording device according to claim 10, wherein the impermeable filter element is the second filter element.

12. The audio recording device according to claim 10, wherein the impermeable filter element comprises a fourth filter element, and the noise reduction filter further comprises the fourth filter element.

13. The audio recording device according to claim 10, wherein a distance D2 between the sound receiving surface of the first filter element and the sound receiving surface of the third filter element is larger than a distance D1 between the central axis of the first microphone inlet and the central axis of the second microphone inlet.

14. A hearing aid system comprising:

a hearing aid device configured to be worn at an ear of a user; and an audio recording device, wherein the audio recording device comprises a microphone, a noise reduction filter, a first sound tube having a first end and a second end, and a second sound tube, wherein the first sound tube has a first microphone inlet at the first end configured to capture sound, and the microphone is located at the second end of the first sound tube, the first microphone inlet having a central axis;

wherein the noise reduction filter comprises:

a first filter element made of a first material configured to filter out wind noise, wherein the first filter element comprises a first surface facing the first microphone inlet; and a second filter element made of a second material configured to be impermeable to wind;

wherein the second filter element is located at the central axis so that a first part of a sound wave travelling towards the first microphone inlet is prevented by the second filter element from passing through a second surface of the first filter element into the first filter element, where the second surface is positioned at the central axis; wherein the first filter element further comprises a sound receiving surface allowing a second part of the sound wave to propagate into the first filter element without interacting with the second filter element;

wherein the audio recording device is configured to record an audio signal and transmit the recorded audio signal to the hearing aid device; and wherein the noise reduction filter further comprises a third filter element configured to filter out wind noise, wherein the third filter element comprises a first surface configured to face towards a second microphone inlet of the second sound tube, wherein the second filter element or a fourth filter element is configured to prevent a third part of the sound wave from passing through a second surface of the third filter element into the third filter element, and wherein the third filter element comprises a sound receiving surface allowing a fourth part of the sound wave to propagate into the third filter element without interacting with the second filter element or the fourth filter element.

* * * * *

UNITED STATES PATENT AND TRADEMARK OFFICE

CERTIFICATE OF CORRECTION

PATENT NO. : 9,294,829 B2
APPLICATION NO. : 13/227453
DATED : March 22, 2016
INVENTOR(S) : Gorm Dannesboe et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1140 days.

Signed and Sealed this
Second Day of August, 2016

Michelle K. Lee

Michelle K. Lee
*Director of the United States Patent and Trademark Office*